US006412890B1

(12) United States Patent
Kaneko et al.

(10) Patent No.: US 6,412,890 B1
(45) Date of Patent: Jul. 2, 2002

(54) PEDESTAL FOR PROTECTING AN ORNAMENT FROM AN EARTHQUAKE

(76) Inventors: Tomonao Kaneko, 138-8, Machiya, Turugashima-city, Saitama-ken; Kouichi Murakoshi, 130 Yaoroshi, Hannou-city, Saitama-ken, both of (JP)

( * ) Notice: Subject to any disclaimer, the term of this patent is extended or adjusted under 35 U.S.C. 154(b) by 0 days.

(21) Appl. No.: 09/559,434

(22) Filed: Apr. 27, 2000

(51) Int. Cl.[7] ..... A47F 3/00

(52) U.S. Cl. ..... 312/117; 312/114; 109/46

(58) Field of Search ..... 312/327, 328, 312/329, 319.1, 319.2, 114, 117, 121; 248/550, 551, 636, 638, 559, 618; 109/2, 3, 4, 46

(56) References Cited

U.S. PATENT DOCUMENTS 1,696,522 A * 12/1928 Clegg et al. ..... 109/46
5,165,768 A * 11/1992 Zarrabi et al. ..... 312/114
5,671,984 A * 9/1997 Kodera ..... 312/114
5,853,235 A * 12/1998 Barnes ..... 312/117

FOREIGN PATENT DOCUMENTS

GB 668942 * 3/1952 ..... 109/46
TW 323468 12/1997

* cited by examiner

*Primary Examiner*—James O. Hansen
(74) *Attorney, Agent, or Firm*—Israel Gopstein

(57) ABSTRACT

A pedestal capable of quickly, safely, and securely protecting an exhibited ornament and effectively preventing the ornament from being overturned, dropped, or damaged. The pedestal is constituted so as to open a pair of openable shutter plates (6) and (7) by using a support stand (1) whose top and bottom are provided with a pair of openings (5) and (11) so that they are faced to each other, setting the two openable shutter plates (6) and (7) to the top-side opening (5) of the support stand (1) so that they can be closed while butting them each other at the central portion of the opening (5), suspending the upper-end opening margin **(12*a*) of a bag (12) having a cushioning performance to catch the ornament from the lower portion of the bottom-side opening (11), the pedestal further including a drive (20) for the shutter plates and a vibration sensor (22) and operating the drive (20) when the vibration sensor (22)** detects vibrations due to an earthquake.

7 Claims, 6 Drawing Sheets

PEDESTAL FOR PROTECTING AN ORNAMENT FROM AN EARTHQUAKE

BACKGROUND OF THE INVENTION

1. Field of the Invention

The present invention relates to a pedestal preferably used to put an ornament such as an expensive pottery or an industrial glass art object on a cabinet in a reception room, exhibit the ornament in a shop or exhibit hall, or enshrine an important cultural property such as a Buddhist image.

2. Prior Art

When the above-described fragile ornament is mounted on a cabinet, exhibit rack, or display rack, it may be damaged or broken because it is dropped due to vibrations when an earthquake occurs. Therefore, an ornament in a cabinet or display rack has been prevented from being overturned or dropped so far by setting a cord or a support bar around the ornament. Moreover, in the case of a very large ornament, a plurality of cords are set by keeping a predetermined interval from each other. However, in the case of the above method, cords or support bars are uncertain as overturn or drop preventing means. Moreover, not only they are bad in appearance but also they may be obstacles for appreciation of an ornament.

Therefore, a pedestal for protecting an ornament from being overturned, dropped, or damaged due to vibrations is known which has a top plate, intermediate plate, and bottom plate for mounting an ornament or the like whose top view is quadrangle and is constituted by vertically arranging them by keeping a predetermined interval from each other and setting a cushioning material (spring) between the plates.

Problems to Be Solved by the Invention

However, because the above conventional pedestal is constituted so as to absorb vertical and horizontal vibrations, it cannot correspond to vibrations including pitching, rolling, and complex shaking. Therefore, as already described, a cord or the like is set around an ornament in a case at present and thereby, a problem occurs that appearance is bad.

Moreover, the above pedestal has problems on manufacture such as what values should be set as a proper vertical deformation value and a proper horizontal moving distance of a cushioning material, what type of member can be used as a cushioning material, and how the cushioning material can be used so as not to easily receive influences of shaking correspondingly to the magnitude of vibration or the weight of an ornament or the like.

SUMMARY OF THE INVENTION

Object

The present invention is made to solve the above conventional problems and its object is to provide a pedestal capable of quickly, safely, and securely protecting an exhibited ornament or the like and effectively preventing the ornament or the like from overturning, dropping, or damaging due to vibrations by constituting the pedestal so as to open a pair of shutter plates provided for the top plate of a support stand by a shutter-plate drive interlocking with a vibration sensor, and drop and store an ornament or the like mounted on the shutter plates in a catching bag having a cushioning performance opened and suspended below the support stand while it is wrapped with a fabric.

Means for Solving the Problems

To achieve the above object, the pedestal as depicted in FIG. 1 is constituted so as to open a pair of openable shutter plates by having a support stand whose too and bottom are provided with a pair of openings so that they are faced to each other, setting the two openable shutter plates to the top-side opening of the support stand so that they are butted each other at the central portion of the opening and openable, suspending the upper-end opening margin of a bag having a cushioning performance to catch an ornament or the like from the lower portion of the bottom-side opening of the support stand, setting a drive and a vibration sensor to the shutter plates, and operating the drive when the vibration sensor detects vibrations due to an earthquake.

The pedestal as depicted in FIG. 1 is constituted so as to open a pair of openable shutter plates at the same time by mounting a plurality of support stands on a leg-provided table, forming a plurality of openings on the top of the support stand, setting the two shutter plates so that they are butted each other at the central portion of each of the openings and openable, moreover forming openings equal to the number of openings at the top of the support stand on the table so as to face the openings of the support stand, suspending the upper-end opening margin of a bag having a cushioning performance to catch an ornament or the like from each of the openings, setting a drive for each of the shutter plates and a vibration sensor, and operating each drive when the vibration sensor detects an earthquake.

The pedestal of claim 3 of the present invention for protecting an ornament or the like from an earthquake or the like is constituted by providing a fastening cord for the outer periphery of a bag for catching an ornament or the like so that the volume of the bag can be adjusted in accordance with the size of the ornament or the like.

The pedestal as depicted in FIGS. 1–2 & 5–7 is constituted by forming a bag for catching an ornament or the like of a net cloth or fabric made of a material having a cushioning performance.

Functions

While a pair of opening-closing shutter plates is horizontally closed by their close-stated-holding and opening mechanism, an ornament is mounted on the central portion of the both shutter plates through a fabric. If an earthquake occurs under the above state, a vibration sensor detects vibrations, a relay switch of a driving source is turned on, power is supplied from a power supply to a magnet portion of a main relay for operating a rotary solenoid, thereby a relay operates, and a rotary solenoid is turned on.

Because the rotary solenoid is turned on, the driving shaft of the rotary solenoid is rotated, closed-state holding of the close-sate-holding and opening mechanism is canceled, either shutter plate is opened downward and at the same time, support of a facing end by a support plate of the shutter plate is canceled. Thereby, the other shutter plate is also opened downward. Thus, the ornament or the like is dropped and stored in a lower catching bag while wrapped with the fabric. Because an impact to the ornament when dropped is absorbed by the bag having a cushioning performance, the ornament is not damaged even if dropped downward.

Moreover, because power can be supplied from the power supply to a plurality of rotary solenoids through the solenoid-operating main relay, it is possible to open a plurality of support stands by one driving source. After the earthquake stops, the closed-state-holding and opening mechanism is locked to a closed-state-holding state by resetting the vibration sensor and opening the shutter plates and the shutter plates are kept at the normal horizontal position.

BRIEF DESCRIPTION OF THE DRAWINGS

FIG. 5 shows an illustration of another bag for catching an ornament or the like;

DESCRIPTION OF THE PREFERRED EMBODIMENT

An embodiment of a pedestal of the present invention for protecting an ornament or the like from an earthquake or the like is described below by referring to the accompanying drawings.

Figure 1:
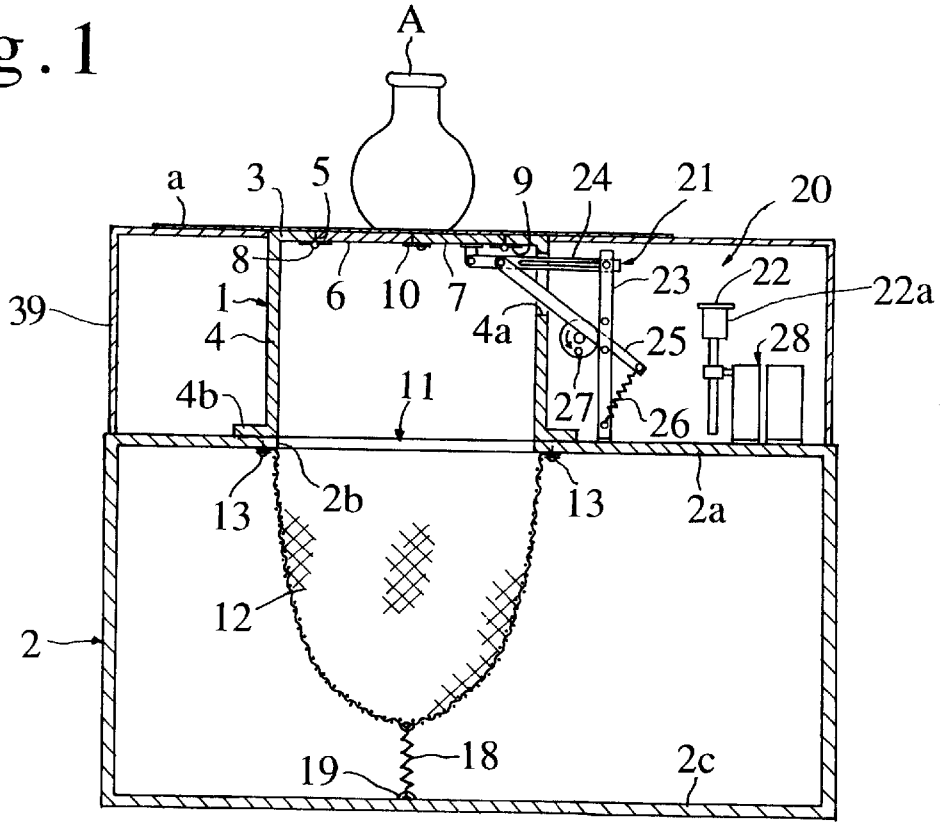
FIG. 1 shows a longitudinal sectional view of a normal state in which an ornament or the like is mounted on shutter plates of a support stand.
Figure 2:
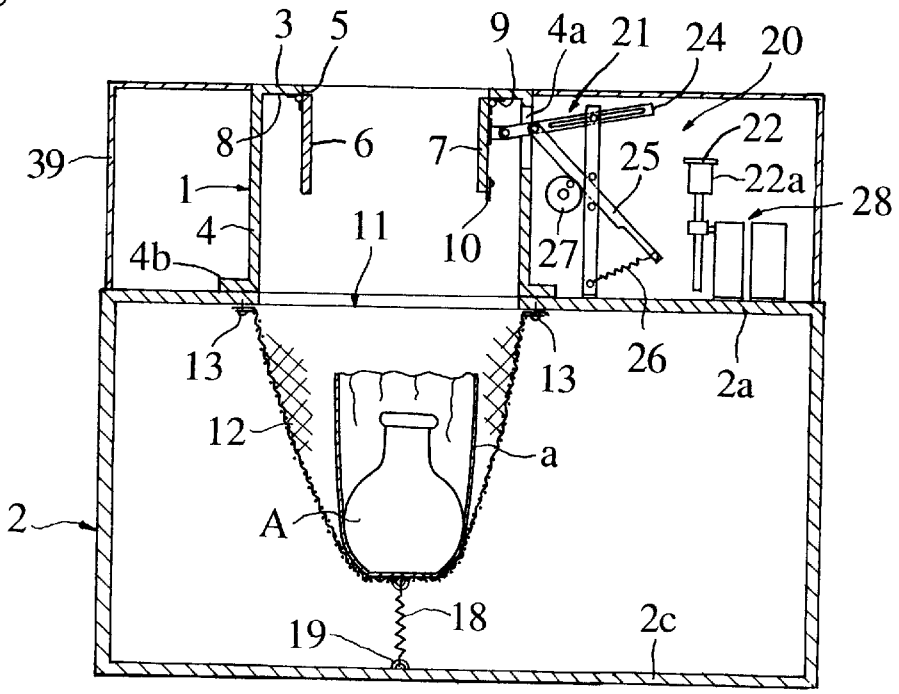
FIG. 2 shows a longitudinal sectional view of a state in which an earthquake occurs, shutter plates are opened, and an ornament or the like is dropped and stored in a catching bag.
Figure 3:
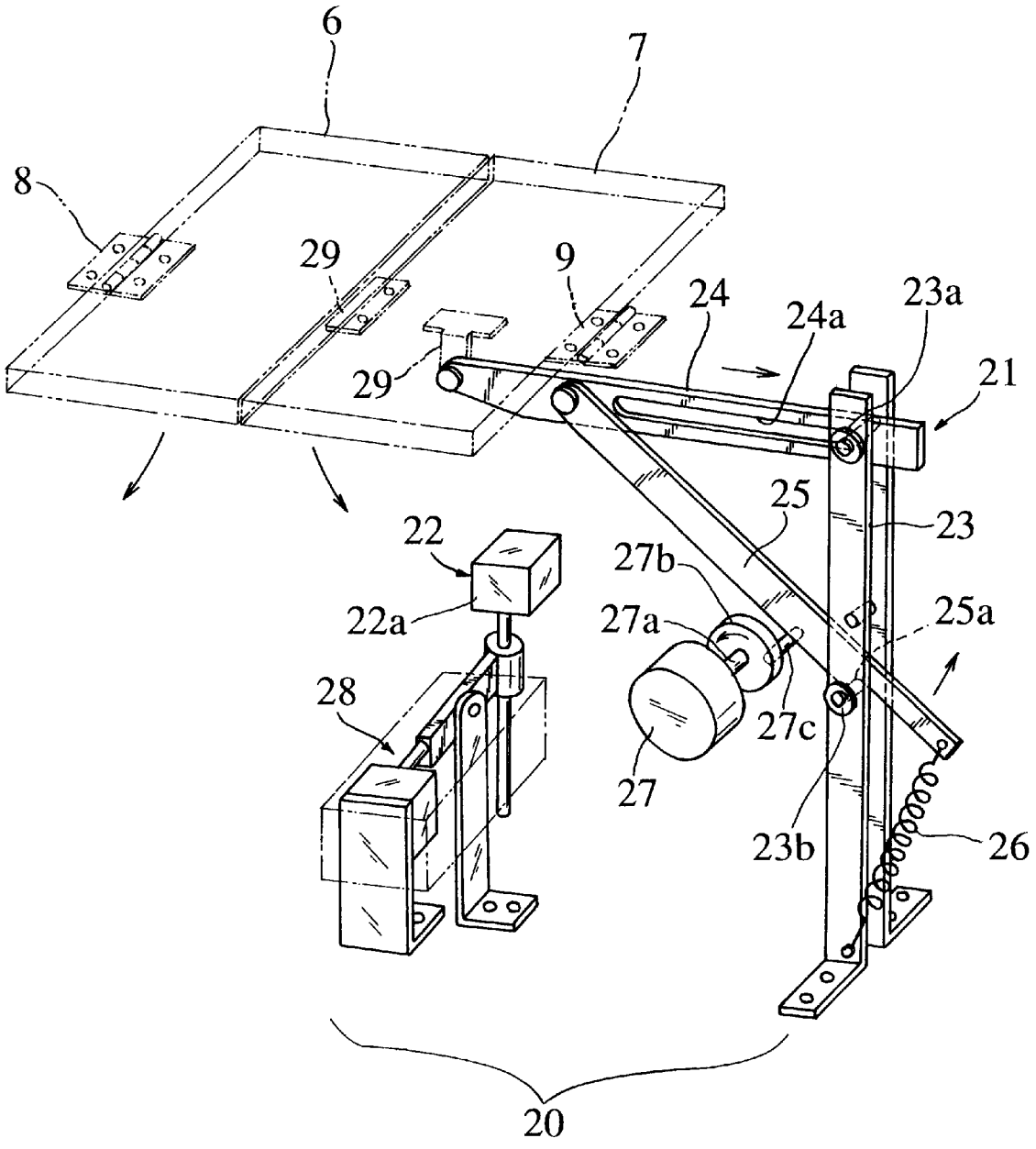
FIG. 3 shows perspective views of shutter plates, their drive, and a vibration sensor.
Figure 4:
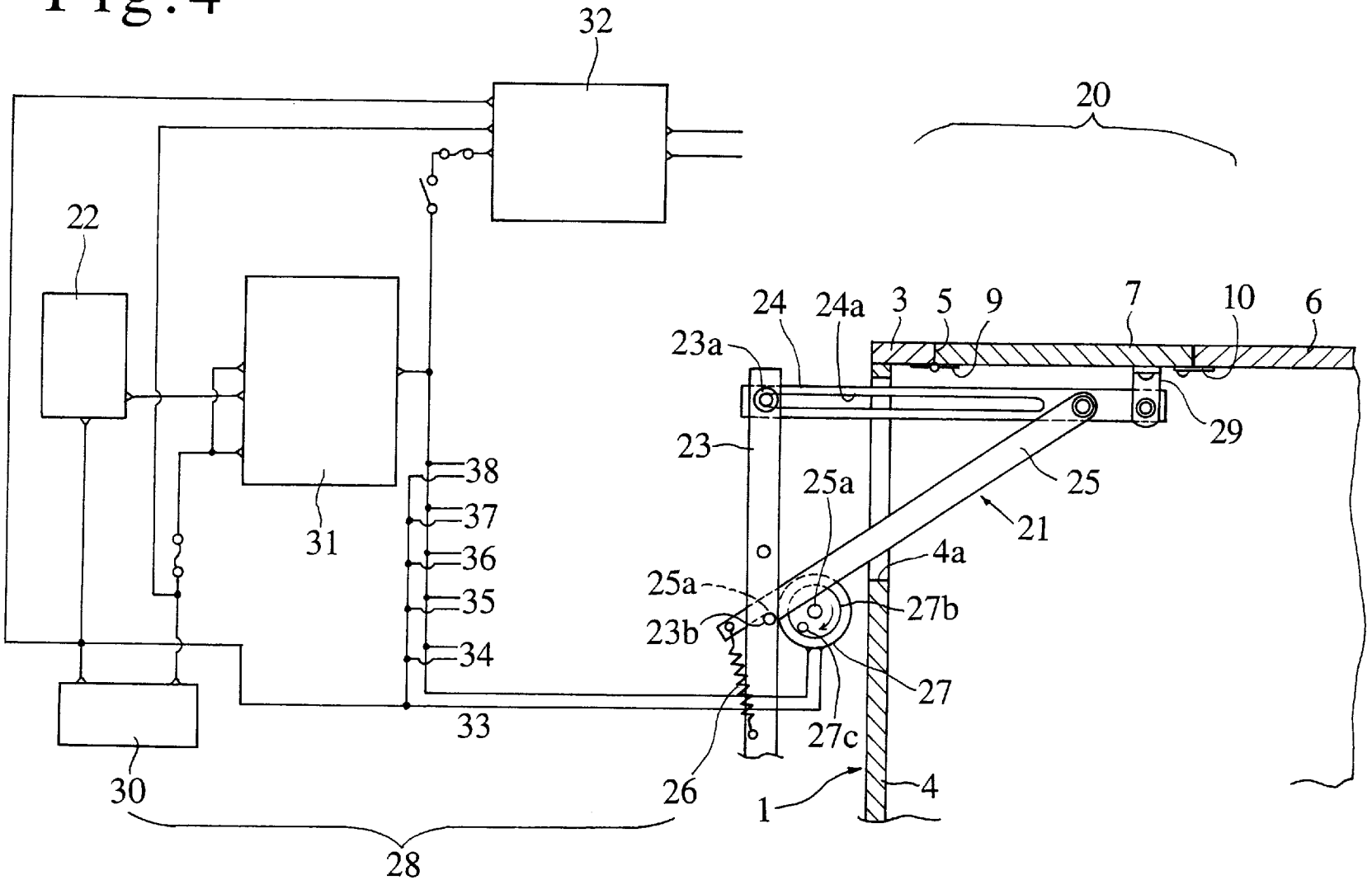
FIG. 4 shows a shutter-plate drive and its electrical wiring illustration.
Figure 5:
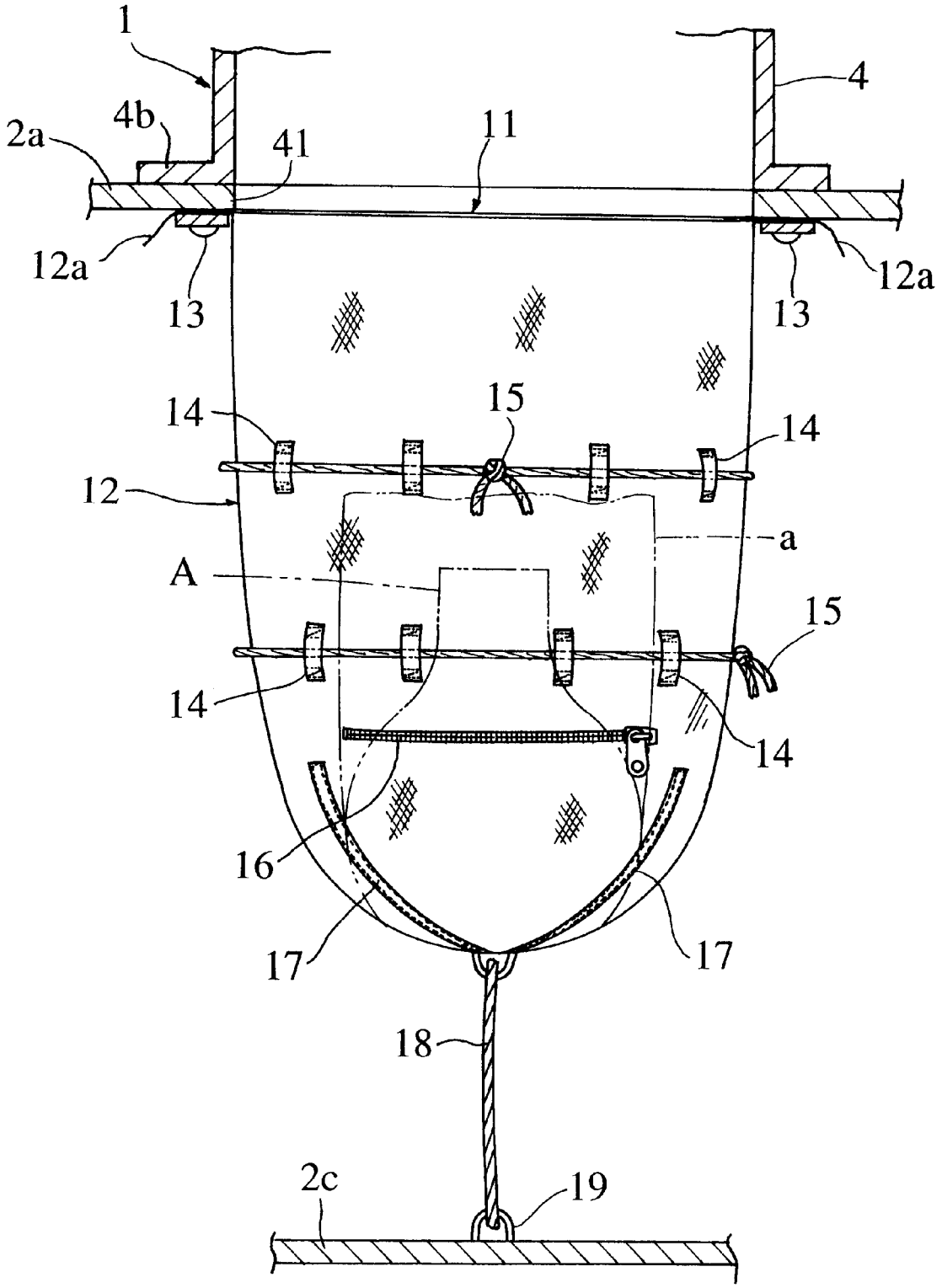
Figure 6:
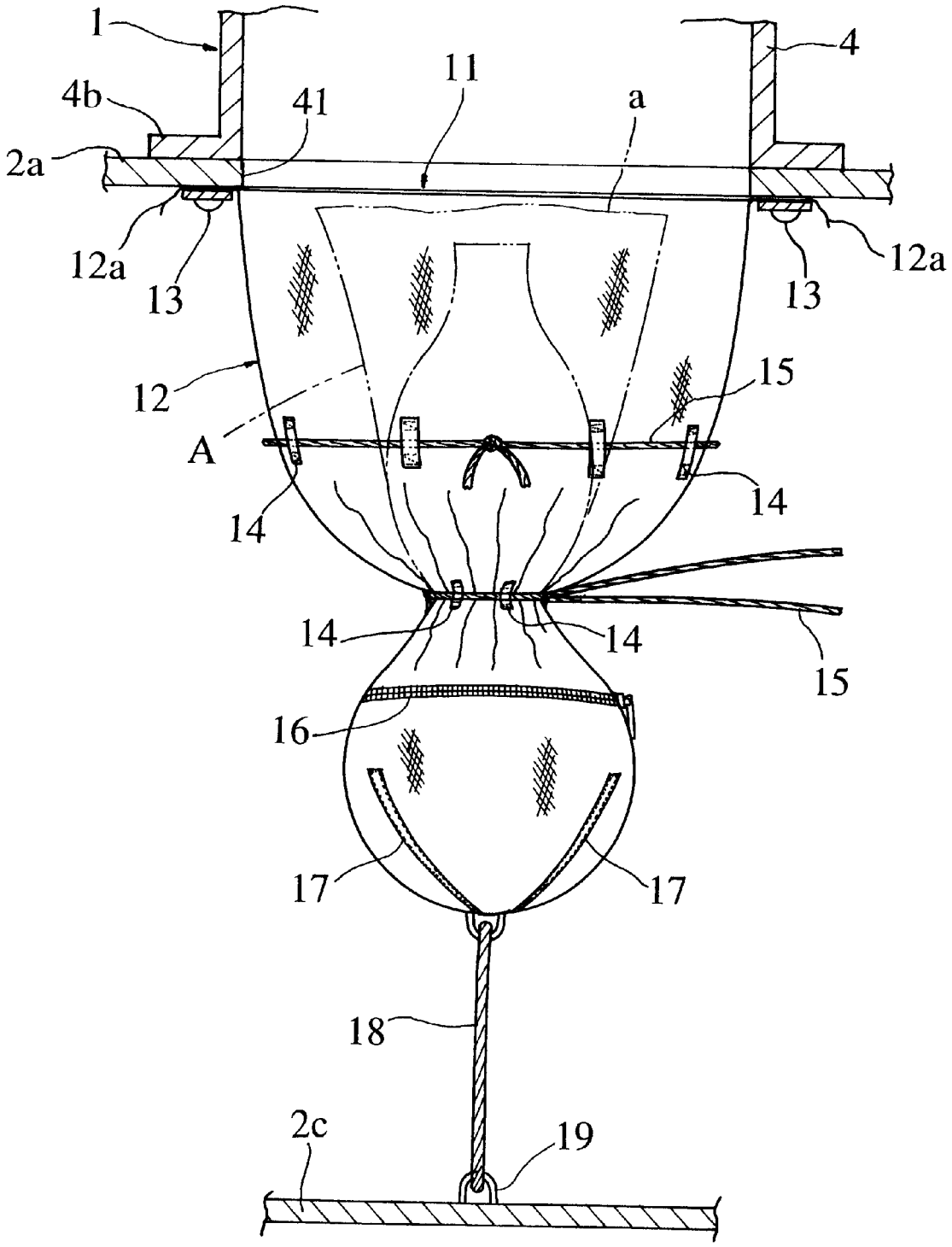
FIG. 6 shows an illustration of a stare in which the middle of the catching bag in FIG. 5 is fastened by a fastening cord.
Figure 7:
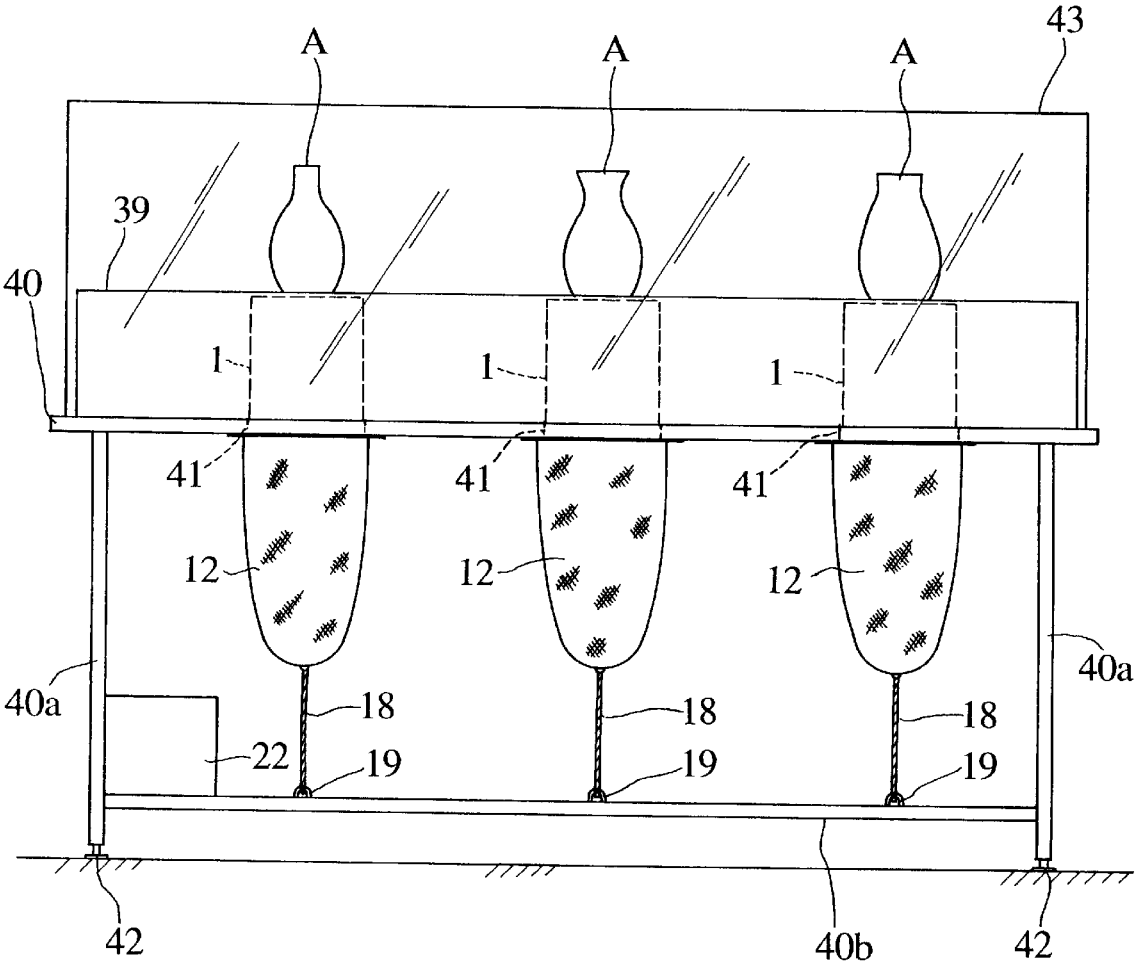
FIG. 7 shows a general front view of a pedestal on which a plurality of ornaments can be exhibited.

FIG. 1 shows a longitudinal sectional view of a pedestal under the normal state in which an ornament or the like is mounted on shutter plates of a support stand, FIG. 2 shows a longitudinal sectional view of a pedestal when an earthquake occurs, shutter plates are opened, and an ornament or the like is dropped and stored in a catching bag, FIG. 3 shows perspective views of shutter plates, their drive, and a vibration sensor, FIG. 4 shows a shutter-plate drive and an electric-wiring illustration, FIG. 5 shows an illustration of another bag for catching a pedestal or the like, FIG. 6 shows an illustration of a state in which the catching bag is fastened by a fastening cord, and FIG. 7 shows a general front view of a pedestal capable of exhibiting a plurality of ornaments or the like.

As shown in FIGS. 1 and 2, the pedestal is constituted by combining a support stand 1 of an ornament A or the like and a large housing 2 for mounting the stand 1 on it.

The support stand 1 is formed by flatly having predetermined biaxial dimensions and provided with an opening 5 flatly having predetermined biaxial dimensions (flat square) inside of a side 4 by squarely opening the central portion of a top 3.

A pair of shutter plates 6 and 7 formed into almost the same size is supported to the opening 5 while the plates 6 and 7 are butted each other at their central portion so that the plates 6 and 7 can be horizontally closed at the top 3 by hinges 8 and 9 and almost vertically opened downward.

A stopper 10 for horizontally keeping, for example, the shutter plate 6 closed is protruded by fixing the plate 6 to the back of the faced end of the plate 7 in the case of the illustrated example.

The bottom of the support plate 1 is opened at the same dimensions as the inside of the side 4 to form a flat square opening 11 and a flange 4*b* is protruded outward at the lower end of the side 4 of the support plate 1.

Moreover, an opening 2*b* having the same shape and same size as the opening 11 of the bottom 5 of the support plate 1 set on a top board 2*a* of the housing 2 is formed on the top board 2*a* so as to face the opening 11.

The upper-end opening margin 12*a* of the catching bag 12 for the ornament A or the like is suspended at the lower margin of the opening 2*b* of the top board 2*a* of the housing 2 by a plurality of fastening plates 13. . . Thereby, the openings 5 and 11 of the support stand 1, opening 2*b* of the housing 2, and upper-end opening margin 12*a* of the catching bag 12 are vertically communicated and formed.

The catching bag 12 is formed of a material having a cushioning performance, that is, an optional cushioning material such as net cloth or fabric made of plastic fiber having a large impact-absorbing capacity so that an impact when the ornament A or the like is dropped and stored in the catching bag 12 can be absorbed and prevented from being damaged or broken due to a drop.

Moreover, as shown in FIGS. 5 and 6, the catching bag 12 is formed into a size large enough to the ornament A or the like, cord loops 14. . . are set by keeping a predetermined interval from each other at one stage or over a plurality of stages (two stages in the case of the illustrated example) in the transverse direction in the middle, and fastening cords 15. . . are made to pass through the cord loops 14. . . Thereby, when the ornament A or the like is large, the catching bag 12 is formed so that the ornament A or the like can be caught by the bottom of the catching bag 12 without using the fastening cords 15. . . as shown in FIG. 5. However, when the ornament A or the like is small, the catching bag 12 is formed so that the ornament A or the like can be caught above the bag 12 by tying the lower fastening cord 15 and thereby binding the catching bag 12 in the middle.

Moreover, the catching bag is formed so that the ornament A or the like dropped and stored in the catching bag 12 can be easily taken out by setting a fastener 16 below the catching bag 12 in the transverse direction of the bag 12*s* and opening the lower side of the bag 12. In FIGS. 5 and 6, symbol 17 denotes an reinforcing tape attached to the lower portion of the catching bag 12 and 18 denotes a catching-bag-12 bracing cord which is suspended from the central lower portion of the bag 12 and whose lower end is connected and fixed to a bottom plate 2*c* of the housing 2 through a fitting 19.

Thus, a window hole 4a is formed above the side 4 of the support stand 1 and a drive 20 of the shutter plates 6 and 7 is provided on the top board 2*a* of the housing 2 outside of the window hole 4*a*.

As shown in FIGS. 1 to 4, the driver 20 is provided with a closed-state-holding and opening mechanism 21 and a vibration sensor 22 of the shutter plates 6 and 7.

The closed-state-holding and opening mechanism 21 is constituted of a stanchion 23 vertically fixed to the top board 2*a* of the housing 2, a guide arm 24, a locking arm 25, a tension spring 26, a rotary solenoid 27, and a closed-sate-canceling driving source 28 of the closed-state-holding and opening mechanism 21.

The guide arm 24 is supported by a slot 24*a* penetrated in the longitudinal direction by passing through a pin 23*a* fixed nearby the upper end of the stanchion 23 so as to be slidable in the longitudinal direction and rotatable in the vertical direction and the front end of the arm 24 is rotatably journaled by a bracket 29 set to the back of the shutter plate 7 by passing through the window hole 4*a*.

As for the locking arm 25, an engaging concave portion 25*a* is formed at the bottom face nearby the proximal end of the arm 25 and the front end of the arm 25 is rotatably supported nearby the front end of the guide arm 24 by passing through the window hole 4*a*. Moreover, the locking arm 25 is tilted from the front end toward the proximal end and the engaging concave portion 25*a* is removably engaged with a horizontal pin 23*b* protruding to the almost intermediate portion of the stanchion 23.

Furthermore, the tension spring 26 is tensed by securing the end to the proximal end of the locking arm 25 and the lower portion of the stanchion 23 and the engagement between the engaging concave portion 25*a* and the pin 23*b* is kept to keep the shutter plates 6 and 7 horizontally closed.

As shown in FIGS. 1 to 4, the rotary solenoid 27 is set by protruding an eccentric pin 27*c* beyond a disk 27*b* fixed to a driving shaft 27*a*, the eccentric pin 27*c* is eccentrically rotated when the rotary solenoid 27 rotates to push up the bottom face of the locking arm 25. Thereby, the proximal end of the locking arm 25 is pushed up against the tension of the tension spring 26 to cancel the engagement between the engaging concave portion 25*a* and the pin 23*b*.

As described for FIG. 4 in detail, the closed-state-canceling driving source 28 of the closed-state-holding and opening mechanism 21 is constituted by electrically connecting a power supply 30, a rotary-solenoid-operating main relay 31, the already-described rotary solenoid 27, and a battery charger 32 with the vibration sensor 22.

Moreover, the driving source 28 is provided with a plurality of power supply circuits 33 to 38 (six circuits in the case of the illustrated example) for the rotary solenoids 27 so that the circuits 33 to 38 are electrically connected with the rotary solenoids 27 . . . of the support stands 1. . . as shown in FIG. 7.

The power supply 30 is constituted so that power is supplied to a rotary solenoid from a battery (not illustrated) even if public current is cut off due to a big earthquake. Thereby, the ornament A or the like is securely protected even under a power failure.

The earthquake sensor 22 uses any on of a pendulum system in which a limit switch is turned on due to a tilt of a pendulum 22*a* to operate the main relay 31 for operating the rotary solenoids 27. . . and operate the rotary solenoids 27. . . as described for this embodiment, an accelerometer system of operating a not-illustrated accelerometer→A/D→computer (filtering and input of operation determining value) →rotary-solenoid-operating main relay 31→rotary solenoids 27. . . (in this case, it is assumed that an operation determining value to be input is set to 2 to 9 gal when operating the system at a seismic intensity of 2 and set to 10 to 30 gal when operating the system at a seismic intensity of 3), an operating system according to a reflectance due to a level change when an earthquake occurs by using a laser beam, an operating system according to light interruption due to a level change, and a reed switch system which operates when a permanent magnet is vertically moved due to a level change.

It is possible to set only one support stand 1 to a pedestal or a plurality of support stands 1 to the pedestal as shown in FIG. 7 (three support stands in the case of the illustrated example). Also in this case, it is enough to set one vibration sensor 22 in the drive 20 of the shutter plates 6 and 7. When the vibration sensor 22 detects vibrations, power is supplied to rotary solenoids 27. . . of the closed-state-holding and opening mechanism 21 for each support stand 1, the closed-state holding of the closed-state-holding and opening mechanism 21 is canceled, and the shutter plate 7 is opened downward and simultaneously support of the faced end of the shutter plate 7 by the stopper 10 is canceled. Thereby, the shutter plate 6 is also opened downward.

Thereby, the ornament A or the like is wrapped by a fabric"a" on the shutter plates 6 and 7, passes through the lower opening, and is dropped and stored in the catching bag 12 from the upper-end margin 12*a* of the catching bag 12.

Because an impact due to a drop of the ornament A or the like is absorbed by the catching bag 12 made of a material having a cushioning performance, damage of the ornament A or the like due to the drop is prevented.

In FIGS. 1, 2, and 7, symbol 39 denotes the housing 2 in which only the upper face of the support stand 1 is exposed or a cover to be mounted on a table to be described later. In FIG. 7, support stands 1. . . are mounted on a large table 40 and upper-end opening margins 12*a* of a plurality of catching bags 12 (three bags in the case of the illustrated example) are suspended from lower faces of openings 41 communicated with the openings of the support stands 1. . . of the table 40 by fastening plates similarly to the above case. A connecting rod 40*b* is horizontally set to legs 40*a* of the table 40 and the bracing cord 18 at the lower end of each catching bag 12 is connected and fixed to the connecting rod 40*b* through the fitting 19. In FIG. 7, symbol 42 denotes a height adjusting screw and 43 denotes a transparent glass cover (or the support stands 1. . .

Advantages of the Invention

Because the present invention is constituted as described above, it has the advantages described below.

(1) According to claim 1, shutter plates of a support stand are opened by detecting vibrations when an earthquake occurs and an ornament or the like is instantaneously dropped and stored in a lower-side catching bag having a cushioning performance. Therefore, it is possible to effectively prevent an expensive ornament or the like from being damaged or broken.

(2) According to claim 2, a plurality of ornaments or the like can be simultaneously exhibited and protected on one pedestal and moreover, only one electrical driving source (excluding the rotary solenoid 27) of a vibration sensor or shutter plate is required. Therefore, claim 2 is economical and greatly contributes to decrease in size and weight.

(3) According to claim 3, a volume of a catching bag can be adjusted correspondingly to a size of an ornament or the like. Therefore, it is possible to always decrease an impact due to a drop of the ornament or the like and thereby improve the certainty of protection of the ornament or the like.

(4) According to claim 4, a catching bag is made of net cloth or fabric having a cushioning performance. Therefore, it is possible to absorb an impact to a dropped ornament or the like and thereby, further improve the certainty of protection of the ornament or the like.

What is claimed is:

1. A pedestal for protecting an ornament from an earthquake by opening a pair of openable shutter plates, wherein top and bottom portions of a support stand are provided with a pair of openings which face each other, the two openable shutter plates set to the top-side opening of the support stand so that they can be closed while abutting each other at a central portion of the opening, an upper-end opening margin of a bag having a cushioning characteristic being suspended to catch an ornament from a lower portion of the bottom-side opening, the pedestal further including a drive for the shutter plates and a vibration sensor, the drive being operated when the vibration sensor detects vibrations due to an earthquake.

2. The pedestal for protecting an ornament from an earthquake as recited in claim 1, further comprising a fastening cord for an outer periphery of said bath so that the volume of the bag can be adjusted in accordance with the size of the ornament.

3. The pedestal for protecting an ornament from an earthquake as recited in claim 1, wherein said bag is formed of a net cloth or fabric made of a material having a cushioning characteristic.

4. The pedestal for protecting an ornament from an earthquake as recited in claim 1, wherein said pedestal includes a plurality of sets, each set comprising a respective pair of openable shutter plates and a corresponding bag having a cushioning characteristic and including a corresponding drive for the respective pair of shutter plates.

5. A pedestal for protecting an ornament from an earthquake by opening a pair of openable shutter plates at the same time, wherein a plurality of support stands are mounted on a table provided with legs, a plurality of openings formed on the top of the support stand, the two shutter plates set so that they can be closed and opened while abutting each other at a central portion of each of the openings, a plurality of openings equal to the number of openings of the support stand on the table facing the openings of the support stand, an upper-end opening margin of a bag having a cushioning characteristic being suspended to catch an ornament from each of the openings, the pedestal further including, a drive for each of the shutter plates and a vibration sensor, each drive being operated when the vibration sensor detects an earthquake.

6. the pedestal for protecting an ornament from an earthquake according to claim 5, further comprising a fastening cord for the outer periphery of the bag for catching the ornament so that the the volume of the bag can be adjused in accordance with the size of the ornament.

7. The pedestal for protecting an ornament from an earthquake according to claim 5, wherein the bag for catching the ornament is formed of a net cloth or fabric made of a material having a cushioning performance.

* * * * *